US005833503A

United States Patent [19]

Kallio

[11] Patent Number: 5,833,503

[45] Date of Patent: Nov. 10, 1998

[54] BOTTOM WELL AND SEA WATER PIPING SYSTEM FOR VESSELS

[76] Inventor: Jaakko Kallio, Purjehtijankatu 59 C, FIN-26200 Rauma, Finland

[21] Appl. No.: 737,292

[22] PCT Filed: May 30, 1995

[86] PCT No.: PCT/FI95/00303

§ 371 Date: Nov. 8, 1996

§ 102(e) Date: Nov. 8, 1996

[87] PCT Pub. No.: WO95/32892

PCT Pub. Date: Dec. 7, 1995

[30] Foreign Application Priority Data

May 31, 1994 [FI] Finland ..... 942557

[51] Int. Cl.[6] ..... B63H 21/38

[52] U.S. Cl. ..... 440/88; 114/270

[58] Field of Search ..... 440/88, 39; 114/125, 114/198, 270, 151; 165/41

[56] References Cited

U.S. PATENT DOCUMENTS

| | | | |
|---|---|---|---|
| 1,641,670 | 9/1927 | French | 114/198 |
| 2,350,598 | 6/1944 | Faville | 114/198 |
| 3,662,701 | 5/1972 | Cobb | 114/68 |
| 5,289,793 | 3/1994 | Aker | 114/151 |

FOREIGN PATENT DOCUMENTS

| | | | |
|---|---|---|---|
| 851880 | 6/1988 | Finland . | |
| 928085 | 5/1955 | Germany . | |
| 437803 | 3/1985 | Sweden . | |
| 1510670 | 5/1978 | United Kingdom | 114/270 |

OTHER PUBLICATIONS

Finnish Official Action for Finnish Patent Application No. 942557, filed Jul. 4, 1995, Inventor: Jaakko Juhani KALLIO; and English translation of the Finnish Official Action dated Apr. 25, 1995.

*Primary Examiner*—Sherman Basinger
*Attorney, Agent, or Firm*—Beveridge, DeGrandi, Weilacher & Young, LLP

[57] ABSTRACT

A bottom well and sea water piping system for vessels with which system the supply of sea water is provided for a vessel for engine cooling and other uses. The invention has only one bottom well preferably arranged on the vessel's middle line, and that the sea water piping as a whole is on the delivery side of submersible pumps. All the openings and lead-throughs of the bottom well are above the water level, most preferably on a covering plate. The sea water piping system is regulated by a heat regulating valve and a pressure regulating valve. The flow is regulated with an operating speed regulator for the motors of the submersible pumps by means of a frequency converter.

9 Claims, 1 Drawing Sheet

BOTTOM WELL AND SEA WATER PIPING SYSTEM FOR VESSELS

FIELD OF THE INVENTION

The invention relates to a bottom well and sea water piping system for vessels with which system the supply of sea water is provided for a vessel for both cooling water and other use. A bottom well and sea water piping system for vessels comprises a bottom well, pumps, filters, motors of the pumps with a frequency converter, an inlet and an outlet piping with associated equipments, and regulating devices.

BACKGROUND

Bottom wells are conventionally arranged on the vessel's boards in such a manner that part of the well is on the bottom side and part of the intake opening on the board side. Conventional bottom wells are naturally arranged below the water level in such a manner that all the water intake openings are below the water line. Bottom wells on both boards are most often connected by a common suction piping. A connecting suction pipe is arranged below the water level and it acts as a bypass manifold to which pumps are connected. Filters are also arranged on the suction pipe.

The greatest drawback of the conventionally used bottom well systems for vessels has been that the system is almost completely located below the water level. In that case there is always a risk in connection with disturbances and damages that water will gain access to the vessel's inner parts. Conventional bottom well and sea water piping systems normally have several pipe connections to the bottom well below the sea level. One or more suction pipes are connected to the bottom well. Furthermore, a return pipe for warmed water, an air pipe, possible lead-throughs required by compressed air or vapour blasting and lead-throughs of a heating spiral are also connected to the bottom well. It is clear that the above-mentioned lead-throughs arranged below the water level will always be risky. In northern conditions, in particular, bottom wells arranged on the boards are not a very good solution because ice and ice sludge in the sea will often prevent the water intake from the bottom well. It has also been problematic that conventional bottom wells are placed in the most crammed place on a vessel, that is, in the forebody of the engine room. The two bottom wells there and the piping connecting them take an inconsiderably large space. Also, filters and the necessary pumps have often been a problem with regard to their logical placing.

Conventional bottom well and sea water piping systems have also been problematic for users since bottom wells easily accumulate air and ice because of the position of the wells. The removal of ice requires additional heating and attending to the heating. Air causes malfunctions in the pumps and as ice accumulates in the bottom well or the filters, the flow of cooling water is prevented.

SUMMARY OF THE INVENTION

The bottom well and sea water piping system for vessels according to the invention eliminates the above-mentioned drawbacks and it is reliable and user-friendly. The bottom well and sea water piping system for vessels according to the invention is characterized by what is described below in the characterizing part of claims.

The greatest advantages of the bottom well and sea water piping system for vessels according to the invention will thus be the improvement of security and the lowering of the total cost. All parts of the system, piping as well as the openings in connection with the bottom well, are arranged above the sea level so that water will not gain access to the vessel's inner parts in cases of piping or other damages. The bottom well of the invention is in the vessel's midship, whereby it is possible to accomplish advantageous device and piping arrangements, which will essentially reduce the number of pipes, for example. Neither is it necessary to lay pipes transversely in the system of the invention. The position of the bottom well of the invention in the midship prevents air from entering the well, and a very slow flow in the bottom openings will not easily draw bay ice in with them. Furthermore, there is very little ice in the bottom well situated on the vessel's middle line due to a long distance from the bow. The cost of the piping of the invention is lowered e.g. by that piping above the sea level does not need the security systems required by the classification societies. Also, energy is saved in the system of the invention in which an optimal amount of water constantly flows according to each operating situation. The regulation of the system is simple and it is performed by means of two regulating valves with which both temperature and pressure are regulated.

BRIEF DESCRIPTION OF THE DRAWINGS

In the following, the invention will be described in detail with reference to the accompanying DRAWING.

DETAILED DESCRIPTION OF THE PREFERRED EMBODIMENTS OF THE INVENTION

Figure 1:
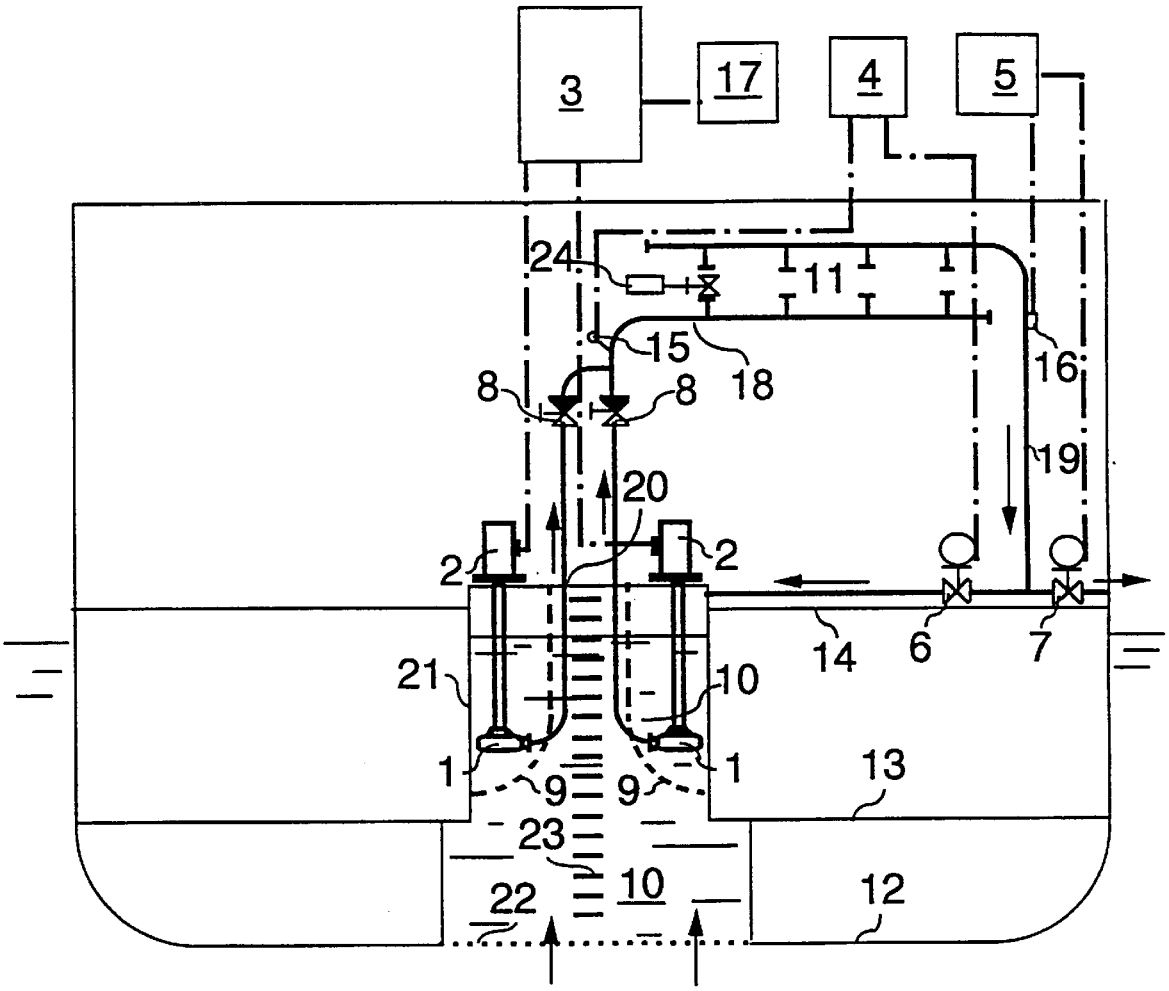

FIG. 1 is a schematic representation of a bottom well and sea water piping system for vessels according to the invention.

In FIG. 1 numeral 1 refers to a submersible pump and numeral 2 to an electric motor or the like driving the pump. The operating speed of the motors 2 is regulated by means of a frequency converter 3. Numeral 4 refers to a temperature regulator and numeral 5 to a pressure regulator. The amount of return flow to the bottom well is regulated by means of a heat regulating valve 6. The amount of water discharged from the vessel is regulated with a pressure regulating valve 7. A back water valve is referred to by numeral 8 and filters by numeral 9. A bottom well is indicated by numeral 10 and the vessel's cooling points by numeral 11. The vessel's bottom is indicated by numeral 12, a double bottom by numeral 13 and a middle deck by numeral 14. The measurement of temperature is performed by means of a temperature sensor 15 and the measurement of pressure by means of a pressure sensor 16. A control and supervision unit is indicated by numeral 17. Numeral 18 refers to an inlet piping of the system and numeral 19 to an outlet piping. A covering plate of the well 10 is indicated by numeral 20, walls by numeral 21 and bottom openings by numeral 22. A step ladder 23 is secured on the wall 21 of the bottom well 10 for checking and maintenance. The cooling circuit of the main engine is equipped with an automatic valve 24.

The bottom well and sea water piping system for vessels according to the invention conducts the supply of sea water needed on the vessel. As almost all parts of the system are above the sea level, except for the bottom well 10, the maintenance of the pumps 1 is also easy to carry out. Similarly, the repair and maintenance of the piping can be done without docking the vessel. A sufficient amount of water is pumped by means of the pumps 1 to the cooling and moving water network 18, 19, depending on the purpose of use. As shown in FIG. 1, the only sea water flow piping that extends into the bottom well are the two pipe sections of inlet piping system 18 which extend from the delivery side of the pumps up to the cover plate such that the submerged pumps intake sea water directly and discharge on their delivery sides to the two pipe sections. The inlet water flow is regulated in the cooling and other points of use 11 by means of the frequency converter 3 which controls the motors 2 of the pumps 1. The total control is accomplished by means of the programmable control and supervision unit 17. The temperature of the cooling water of the system is measured by means of the temperature sensor 15 with which the return flow to the bottom well 10 is controlled via the temperature regulator 4 by means of the heat regulating valve 6. The pressure of the piping is measured by means of the pressure sensor 16 with which the amount of water discharging from the vessel is controlled via the pressure regulator 5 by means of the pressure regulating valve 7.

The bottom well 10 arranged on the vessel's middle line may be of a desired physical shape. The well can be made highly stress-resistant by constructing a round well. The step ladder 23 is secured on the side walls 21 for maintenance. The grates acting as filters 9 are easy to maintain. It is also possible to have them detachable so that they can be removed through the covering plate 20 for maintenance. If needed, the bottom grate can also be constructed in such a way that it may be removed through the covering plate 20. Since the cooling of the main engine generally consumes most energy on vessels, the sea water piping system of the main engine should be equipped with a separate automatic valve 24 which closes as the main engine is stopped. Automatic valves 24 can also be mounted on other consumers of water.

It is evident that the bottom well and sea water piping system for vessels according to the invention may vary a great deal within the scope of the idea of the invention. The number of pumps in connection with the bottom well 10 may vary as needed. It is also possible to equip the bottom well 10 with separate fire pumps or pumps intended for a corresponding purpose of use. Also, the position of the well 10 can vary depending on the type of vessel, and the well 10 can be placed in the most preferred position with regard to the vessel's construction. The types of pipes may vary according to the purpose of use. The control system of the sea water piping can also use known computer or the like systems and gain desired advantages depending on the preferred stage of automation.

I claim:

1. A bottom well and sea water piping system for vessels with which system the supply of sea water is provided for a vessel for both cooling and other uses, and which comprises a bottom well (10) provided with a bottom opening (22), walls (21) and a covering plate (20) at the top, pumps (1) with motors (2) driving said pumps for regulating an intake flow of water, a motor speed controller (3) connected with said motors, filters (9) for precluding intake of debris by said pumps, an inlet piping system (18) in line with said pumps for directing sea water to vessel points (11), and an outlet piping (19) leading a return flow of the water to be discharged from the vessel, characterized in that the bottom well (10) is arranged on the vessel's middle line or in its proximity; that a covering plate (20) of said bottom well is positioned with respect to the vessel so as to be above sea level; that the bottom well walls (21) below the water sea level are uninterrupted with openings; and that the flow of the sea water piping system in the inlet and outlet piping (18, 19) is adjusted by measuring temperature and pressure, by means of which a heat regulating valve (6) of a return flow line to the bottom well (10) and a pressure regulating valve (7) of a flow line discharging from the vessel are controlled by heat and pressure regulating control devices (4, 5, 17).

2. A bottom well and sea water piping system for vessels according to claim 1, characterized in that the motor speed controller is a frequency converter (3) arranged to regulate the motor speed and thus the operating speed of the pumps (1), said pumps being submersible and said frequency converter being controlled via a control unit (17).

3. A bottom well and sea water piping system for vessels according to claim 1, characterized in that the system comprises only one bottom well (10), and to the covering plate (20) of which the pumps (1) and the piping (18) are directly connected.

4. A bottom well and sea water piping system for vessels according to claim 1, characterized in that the amount of water flowing in the sea water piping (18, 19) is regulated by said heat and pressure regulating control devices (4, 5, 17) so as to be proportional to consumption.

5. A bottom well and sea water piping system for vessels according to claim 1, characterized in that selected vessel points are cooling circuits which are separately closed by means of automatic valves (24).

6. A bottom well and sea water piping system for vessels according to claim 1, characterized in that the sea water filters (9) are placed in the bottom well (10).

7. A bottom well and sea water piping system for vessels according to claim 1, characterized in that the pumps (1) are provided with a side for water intake and a side for water delivery, and said sea water piping system is on the delivery side of the pumps (1).

8. A bottom well and sea water piping system for vessels according to claim 7 wherein, except for a section of said sea water piping system extending from each of said pumps directly to said covering plate, said bottom well is free of sea water piping used for supplying the vessel with sea water.

9. A bottom well and sea water piping system as recited in claim 1, wherein said bottom well is positioned at or essentially at a mid-ship location of the vessel.

* * * * *